US005998722A

United States Patent [19]

Kondo

[11] Patent Number: 5,998,722

[45] **Date of Patent: *Dec. 7, 1999**

[54] ELECTRONIC MUSICAL INSTRUMENT CHANGING TIMBRE BY EXTERNAL DESIGNATION OF MULTIPLE CHOICES

[75] Inventor: Masao Kondo, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,962

[22] Filed: Jun. 18, 1997

Related U.S. Application Data

[63] Continuation of application No. 08/465,534, Jun. 5, 1995, abandoned.

[30] Foreign Application Priority Data

Nov. 16, 1994 [JP] Japan ..... 6-306921

[51] Int. Cl.[6] ..... G10H 1/06

[52] U.S. Cl. ..... 84/622; 84/659

[58] Field of Search ..... 84/622–625, 659–661, 84/692–700, 735, 736

[56] References Cited

U.S. PATENT DOCUMENTS

| | | | |
|---|---|---|---|
| 4,617,851 | 10/1986 | Sato | 84/622 |
| 4,773,294 | 9/1988 | Iizuka et al. | 84/622 |
| 5,116,192 | 5/1992 | Usa | 84/659 X |
| 5,357,048 | 10/1994 | Sgroi . | |

FOREIGN PATENT DOCUMENTS

| | | |
|---|---|---|
| 0 484 043 A3 | 5/1992 | European Pat. Off. . |
| 0 597 381 A3 | 5/1994 | European Pat. Off. . |
| 59-197090 | 11/1984 | Japan . |
| 6598 | 1/1992 | Japan . |
| 2746157 | 10/1998 | Japan . |

OTHER PUBLICATIONS

AR Keyboard Magazine Excerpted from Keyboard Magazine U.S.A. GPI Publications Jan. Issue (1993 vol. 15 No. 1) (3 Pages in Japanese, With English Translation).

*Primary Examiner*—Stanley J. Witkowski
*Attorney, Agent, or Firm*—Graham & James LLP

[57] ABSTRACT

An electronic musical instrument utilizes a tone generator installed with a plurality of timbres for generating a musical tone having a timbre selected from the installed timbres. A MIDI interface is provided for receiving timbre designation information which designates a primary choice and a secondary choice of desired timbres. A bank selector operates when the primary choice is present in the installed timbres for selecting the same so that the musical tone is generated in a desired timbre of the primary choice, and otherwise operates when the primary choice is absent in the installed timbres for selecting the secondary choice in place of the primary choice from the installed timbres so that the musical tone is generated in another desired timbre of the secondary choice.

31 Claims, 13 Drawing Sheets

ELECTRONIC MUSICAL INSTRUMENT CHANGING TIMBRE BY EXTERNAL DESIGNATION OF MULTIPLE CHOICES

This is a continuation of application Ser. No. 08/465,534 filed on Jun. 5, 1995 now abandoned.

BACKGROUND OF THE INVENTION

The present invention relates to an electronic musical instrument having a MIDI interface capable of transmitting and receiving various musical data for musical operation. More particularly, the invention relates to an electronic musical instrument which can change a timbre according to external control information.

Japanese Patent Application Laid-open No. 59-197090 discloses an electronic musical instrument capable of converting musical tone control information which is externally provided, into internal musical tone control data effective to control characteristics of a musical tone generated by an internal tone generator. More particularly, the disclosed electronic musical instrument operates when the same admits a designation of a timbre which cannot be created, for replacing the designated timbre by another timbre so as to generate musical tones. However, there are easy timbres which can be readily replaced by another timbre and difficult timbres which are not suitably replaced, among various species of instrument timbres. Nevertheless, the conventional electronic musical instrument automatically replaces an unable timbre by an able timbre without practical consideration.

In order to commonly use musical data among different models of the electronic musical instruments, it is desired to assign a common timbre to the different models by an identical timbre code. However, each model has an individual tone generation mechanism with an individual performance. Therefore, each model may have a unique timbre. Further, with regard to the common timbres, a high performance model may install multiple of variations of one common timbre. In application, a simple model having small number of timbre species is used to reproduce musical data which is originally prepared for a complicated model having great number of timbre species. In such a case, the simple model may not be installed with a corresponding timbre. If a missing timbre is replaced by a substitute timbre selected from variations, there is practically no problems. However, if a unique timbre is replaced, the instrument generates inconsistent musical tones to thereby hinder the reproduction of the musical data. Moreover, even with regard to the variations, a simple replacement regardless of timbre installations of individual models may result in rather uniform change of the timbres.

SUMMARY OF THE INVENTION

In view of the above noted drawbacks of the prior art, an object of the present invention is to ensure consistent and selective replacement of an absent timbre by a present timbre.

According to a first aspect of the invention, electronic musical instrument comprises tone generating means installed with a plurality of timbres for generating a musical tone having a timbre selected from the installed timbres, receiving means for receiving timbre designation information which designates a desired timbre, checking means for checking as to if the desired timbre is present in the installed timbres, changing means operative when the desired timbre is present for selecting the same from the installed timbres so that the musical tone is changed to the desired timbre, and unchanging means operative when the desired timbre is absent for selecting from the installed timbres a substitute timbre which is previously designated and confirmed present so that the musical tone is generated in the substitute timbre.

According to a second aspect of the invention, an electronic musical instrument comprises tone generating means installed with a plurality of timbres for generating a musical tone having a timbre selected from the installed timbres, receiving means for receiving timbre designation information which designates at least a first choice and a second choice of desired timbres, and selecting means operative when the second choice is present in the installed timbres for selecting the same so that the musical tone is generated in a desired timbre of the second choice, and otherwise being operative when the second choice is absent in the installed timbres for selecting the first choice in place of the second choice from the installed timbres so that the musical tone is generated in another desired timbre of the first choice.

According to a third aspect of the invention, a system is composed of a plurality of electronic musical instruments, wherein each electronic musical instrument comprises tone generating means installed with a plurality of timbres for generating a musical tone having a timbre selected from the installed timbres, wherein one electronic musical instrument further comprises transmitting means for transmitting succeeding timbre designation information which designates a desired timbre and preceding timbre designation information which designates a substitute timbre in place of the desired timbre, and wherein another electronic musical instrument further comprises receiving means for sequentially receiving the preceding timbre designation information and the succeeding timbre designation information, and selecting means operative when the desired timbre is absent in the installed timbres for selecting the substitute timbre from the installed timbres so that the musical tone can be generated in the substitute timbre.

DETAILED DESCRIPTION OF THE INVENTION

Figure 1:
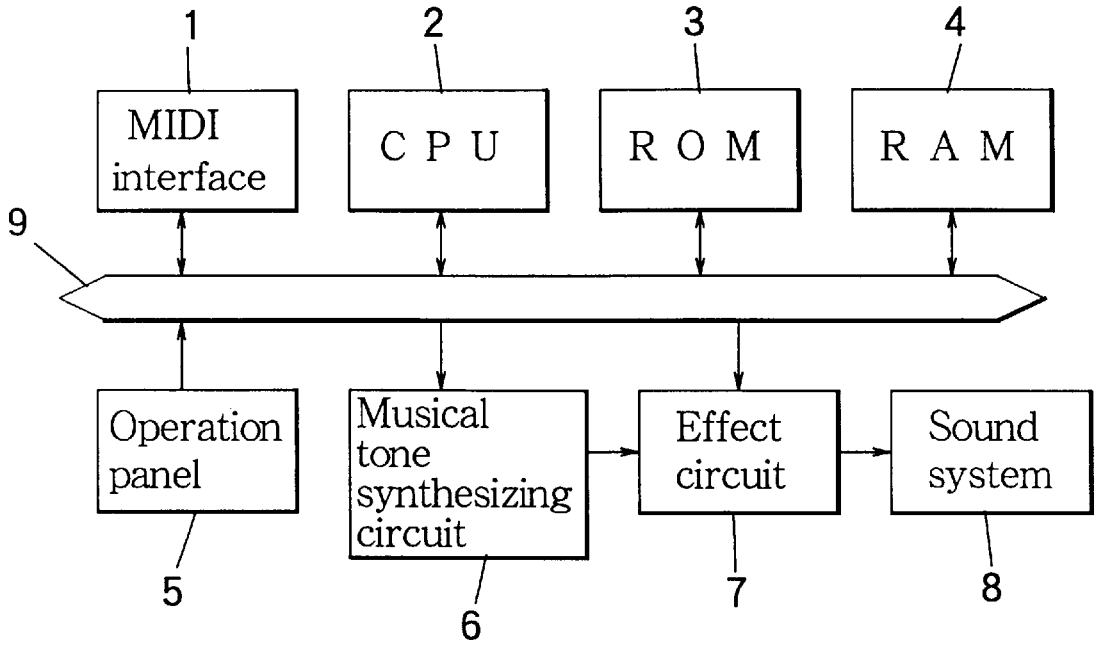
FIG. 1 is an overall block diagram showing one embodiment of an electronic musical instrument according to the invention.

Hereinafter, embodiments of the invention will be described in conjunction with the drawings. FIG. 1 shows a block construction of an electronic musical instrument according to one embodiment of the invention. The electronic musical instrument is comprised of a MIDI interface 1, a CPU (central processing unit) 2, a ROM (read-only memory) 3, a RAM (random access memory) 4, an operation panel 5, a musical tone synthesizing circuit 6, an effect circuit 7, a sound system 8, and a bus line 9. The MIDI interface 1 operates according to a MIDI (Musical Instrument Digital Interface) standard to carry out communication of performance information with an external MIDI instrument. The CPU 2 controls overall operation of the electronic musical instrument. The ROM 3 stores a program executed by the CPU 2 and various control data. The RAM 4 is set with working areas such as registers and flags. The operation panel 5 includes manual pieces actuated by a user. The musical tone synthesizing circuit 6 generates a musical tone signal according to commands from the CPU 2. The effect circuit 7 receives the musical tone signal of an original tone fed from the musical tone synthesizing circuit 6, and imparts various effects to the original tone. The sound system 8 emits a musical sound according to the musical tone signal fed from and modified by the effect circuit 7. The bus line 9 bidirectionally interconnects the above noted components with each other.

Figure 2:
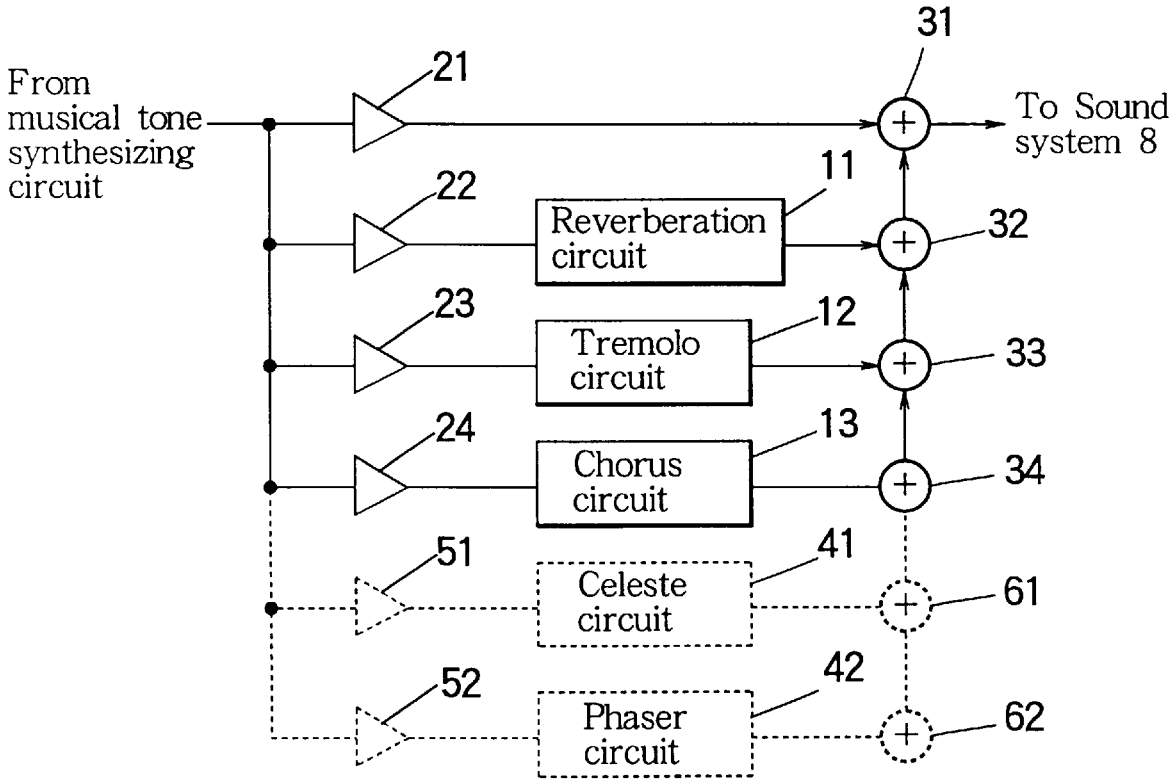
FIG. 2 is a block diagram showing an effect circuit contained in the embodiment of FIG. 1.

FIG. 2 shows a block construction of the effect circuit 7. In this embodiment, the effect circuit 7 is comprised of a reverberation circuit 11, a tremolo circuit 12, a chorus circuit 13, multipliers 21–24 and adders 31–34. These circuits such as the reverberation circuit 11 and the tremolo circuit 12 apply specific effects, and are called "effect application circuit" in general. The effect circuit 7 is individually provided for each of MIDI channels. Otherwise, the effect circuit may be commonly used by time-sharing mode. The musical tone signal of the original tone is inputted from the musical tone synthesizing circuit 6 into the four multipliers 21–24 in parallel, where the musical tone signal is multiplied by given multiplication factors. The multiplier 21 is provided to adjust a tone volume level of the original tone (dry tone) which is reserved free from the effects. The multiplier 22 is provided to adjust a tone volume level of an effect tone which is given a reverberation effect by the reverberation circuit 11. The multiplier 23 is provided to adjust a tone volume level of another effect tone which is given a tremolo effect by the tremolo circuit 12. The multiplier 24 is provided to adjust a tone volume level of a further effect tone which is given a chorus effect by the chorus circuit 13. The adders 31–34 add the dry tone and the several effect tones with each other, which are adjusted to the respective tone volume levels, so as to output a final musical tone signal applied with the effects to the sound system 8.

Next, general description is given for basic operation of this embodiment of the electronic musical instrument. The present instrument receives performance information externally through the MIDI interface 1. The received performance information is stored in a given MIDI buffer. The CPU 2 scans the MIDI buffer and executes a requested process according to event data if the same exist in the MIDI buffer. For example, if the instrument receives note data containing a tone pitch data and a key-on/key-off data, the CPU 2 once writes the note data into a note buffer, and then feeds a command to the musical tone synthesizing circuit 6 to generate a musical tone signal corresponding to the note data. The musical tone synthesizing circuit 6 generates the musical tone signal according to the command from the CPU 2.

Further, the electronic musical instrument transmits performance information such as timbre designation information externally through the MIDI interface 1. In transmission of the timbre designation information, another electronic musical instrument which receives the timbre designation information may not have an identical timbre specified by the timbre designation information. In dealing with such a case, the transmitting electronic musical instrument provisionally transmits generic timbre designation information which designates a generic timbre, and subsequently transmits specific timbre designation information which designates an objective specific timbre. By this, if the receiving electronic musical instrument does not have the specific timbre, the specific timbre is substituted by the generic timbre so as to successfully generate a musical tone signal.

Additionally, the instrument is externally supplied with effect data which determine the multiplication factor of the respective multipliers 21–24, i.e., the tone volume level of the dry and effect tones. Namely, when the effect data are received, the CPU 2 adjusts the tone volume levels of the dry and effect tones in the effect circuit 7 according to the effect data. In such a case, the externally supplied effect data may contain effect species which are not provided in the electronic musical instrument. For example, referring to FIG. 2, another external electronic musical instrument may have additional effect application circuits such as a celeste circuit 41 and a phaser circuit 42, and associated multipliers 51 and 52, and adders 61 and 62, besides the regular effect application circuits 11–13 and the associated multipliers 21–24 and adders 31–34. In such a case, the external electronic musical instrument formulates the effect data which additionally determine the tone volume levels of the celeste and phaser effect tones and which determine the tone volume level of the dry tone under the condition that the celeste and phaser effect tones are involved. This effect data containing the tone volume level setting data of the celeste and phaser are received by the electronic musical instrument of the present embodiment which actually does not have a celeste circuit and a phaser circuit. If the receiving instrument uses the received effect data as they are for setting the tone volume levels of the dry and effect tones in the effect circuit 7, a total effect balance may be hindered since the tone volume level of the dry tone is excessively made small. In view of this, the present electronic musical instrument performs adjustive setting of the effect balance as follows when receiving the effect data which contain the tone volume level setting data of the celeste and phaser which are not owned.

(1) In Case of Receiving the Effect Data "BnH+5AH+Vd"

The top code "BnH" indicates a control change which commands the CPU to control the musical electronic instrument according to a subsequent second byte data. The code BnH is set with n=0 through F to designate one MIDI channel number. The symbol H denotes hexadecimal notation. By such a manner, the effect data can be assigned to each of the MIDI channels. Various registers are provided for each MIDI channel, though not mentioned particularly. The next code "5AH" indicates that a subsequent data presents a dry sending level having a value Vd. The dry sending level has a default value 7FH. Further, a range of the dry sending level value is set from 00H to 7FH. When the data 5AH+Vd are received, the CPU 2 adjusts the dry sending level Vd according to other levels of the effect tones which are set at that moment, and the CPU 2 sets the tone volume level of the dry tone according to the adjusted result. In detail, the original dry sending level Vd is added with sending levels of absent effect species among the reverberation, tremolo, chorus, celeste and phaser, e.g., the celeste and the phaser in this embodiment. Namely, the summed value of the dry sending level is calculated according to the following formula:

$$L=20\cdot\log\{(Vd^4+\Sigma Ve^4/16)^{1/2}/127^2\} \quad (1)$$

where Ve denotes the sending level of the effect species for which the instrument does not have an effectuating ability. In this formula, L denotes the summed dry tone volume level in the unit of dB, and $\Sigma Ve^4$ denotes a sum of four powers of the sending levels of the absent effect species. This dry tone level L is sent to the effect circuit 7 to set the multiplication factor of the multiplier 21. In case that the summed tone volume exceeds 0 dB, the effective tone volume is limited to 0 dB. Further, in case of $(Vd^4+\Sigma Ve^4/16)^{1/2}=0$, the effective tone volume is set to $L=\infty$ (zero tone volume). A tone volume below a lower limit of a dynamic range of the dry sending level is substituted by the lower limit.

(2) In Case of Receiving the Effect Data "BnH+5BH+V"

A code "5BH" indicates that a subsequent data represents a sending level V of the reverberation. When this effect data is received, the CPU 2 calculates a reverberation level L according to the following formula:

$$L=20\cdot\log(V^2/127^2) \quad (2)$$

The calculated reverberation level L is sent to the effect circuit 7 where the multiplication factor of the multiplier 22 is set according to this value.

(3) In Case of the Tremolo, Chorus, Celeste and Phaser Other Than the Reverberation The tone volume level is calculated according to the formula (2) likewise the reverberation. In these cases, the code "5BH" is replaced by 5CH, 5DH, 5EH or 5FH. However, in the cases (2) and (3), if the instrument receives an effect data corresponding to absent effect species, the instrument simply reserves the received effect sending level V for use as Ve in the calculation of the case (1) without setting of the effect circuit. Further, in the cases (2) and (3), $L=\infty$ (zero tone volume) is set if V=0. A tone volume level of a return tone of each effect species is tuned such as to set a loudness of about −12 dB relative to the dry tone when the sending level reaches a maximum value. A tone volume less than a lower limit value of a dynamic range of the sending value is replaced by the lower limit. The default value of the sending level V of the effect is set to 40H for the reverberation and otherwise 00H for the remaining effect species.

Figure 3:
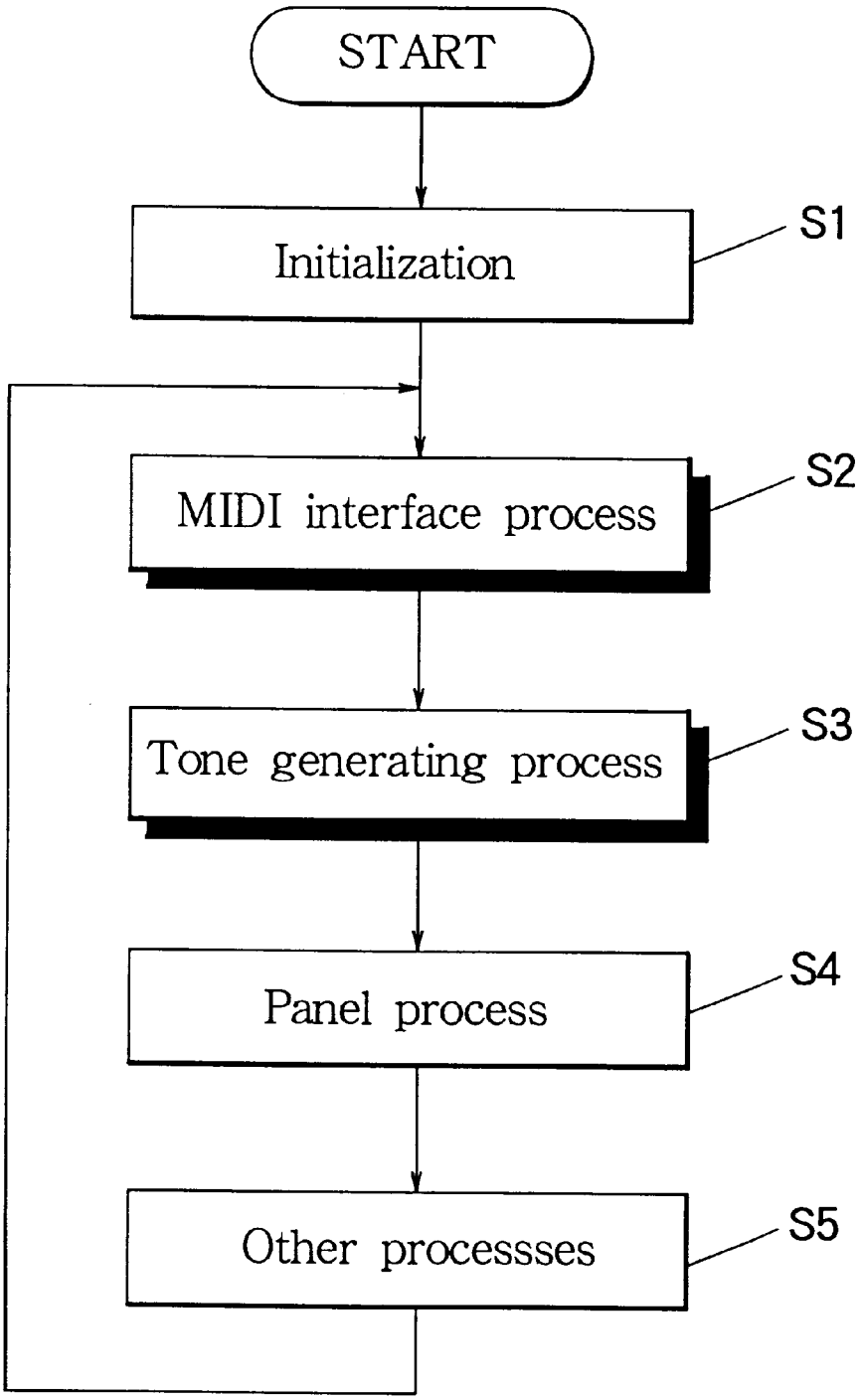
FIG. 3 is a flow chart of a main routine executed by the inventive electronic musical instrument.

Next, detailed description is given for the operation of the electronic musical instrument of the present embodiment in conjunction with flow charts of FIGS. 3–15. First, FIG. 3 shows a main routine of the electronic musical instrument. When a power source of the instrument is turned on, initialization is carried out at a first step S1. Next, a MIDI interface process is carried out at a step S2. A tone generating process is carried out at a step S3. A panel process is carried out at a step S4. Other processes are carried out at a step S5. Thereafter, the routine returns to the step S2 to thereby repeat the subsequent processes.

Figure 4:
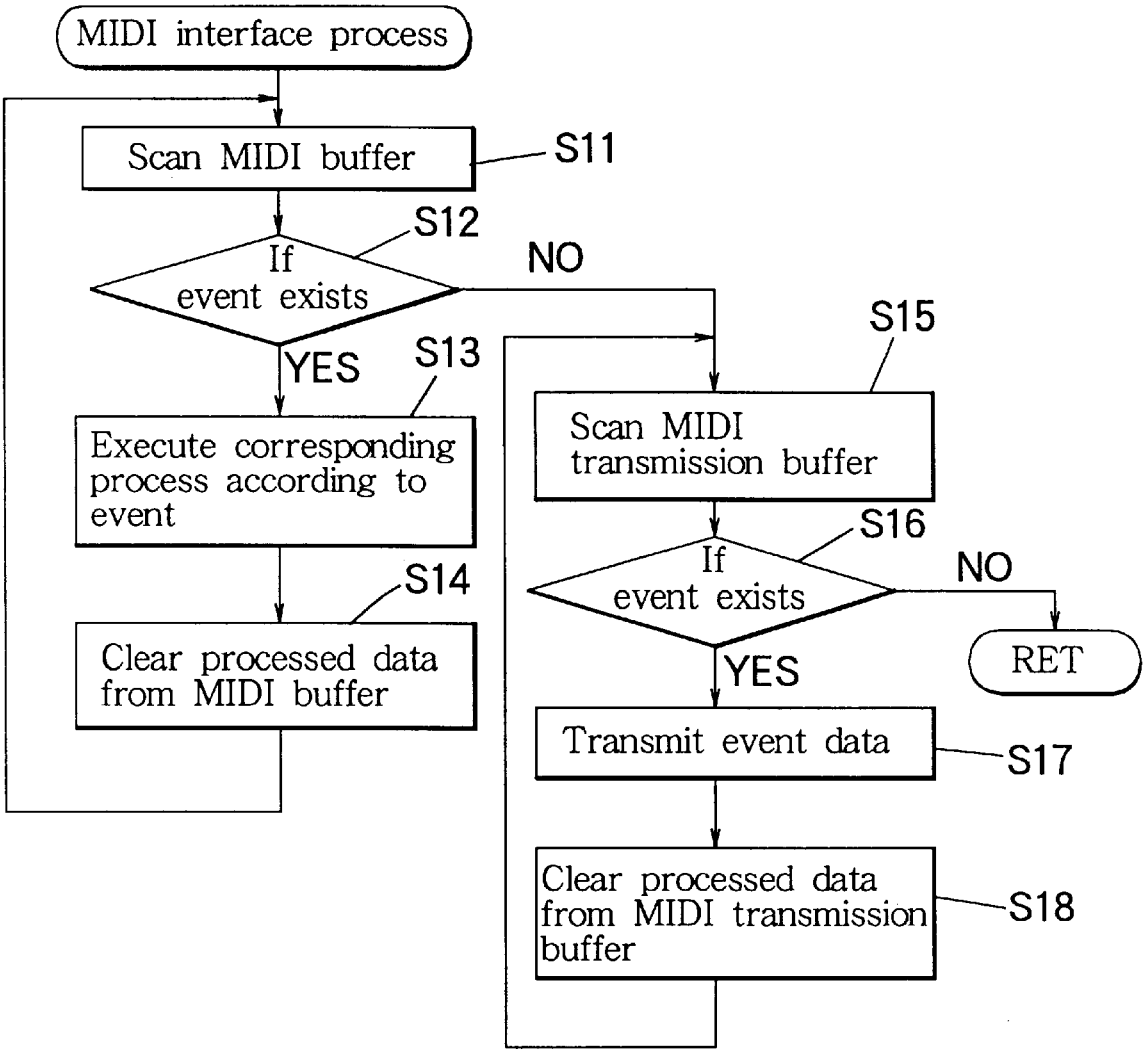
FIG. 4 is a flow chart showing a routine of MIDI interface process.

FIG. 4 shows a routine of the MIDI interface process executed at the step S2 of FIG. 3. First, the MIDI buffer is scanned at a step S11 since received data are once stored in the MIDI buffer. A check is made at a step S12 as to if the MIDI buffer stores an event data. If the event data is not stored, the routine advances to a data transmission process at a step S15 and subsequent steps. If it is confirmed at the step S12 that the event data is stored in the MIDI buffer, a step S13 is undertaken to carry out diverse event process according to the event data as will be shown in FIG. 5 and subsequent figures. After executing the event process, the processed event data is erased from the MIDI buffer at a step S14, thereby returning to the step S11. As long as event data remain in the MIDI buffer, the cycle of the steps S11–14 is repeatedly executed.

At the step S15, a MIDI transmission buffer is scanned, since data to be transmitted are once stored in the MIDI transmission buffer. A check is made at a step S16 as to if the MIDI transmission buffer stores an event data to be transmitted. If the event data is stored, a step S17 is undertaken to transmit the scanned event data through the MIDI interface 1 shown in FIG. 1. After the transmission of the event data, a step S18 is undertaken to erase or clear the transmitted event data from the MIDI transmission buffer, thereby returning to the step S15. As long as event data remain in the MIDI transmission buffer, a cycle of the steps S15–S18 is repeatedly executed. If it is judged by the step S16 that there are no event data to be transmitted, the routine returns.

Figure 5:
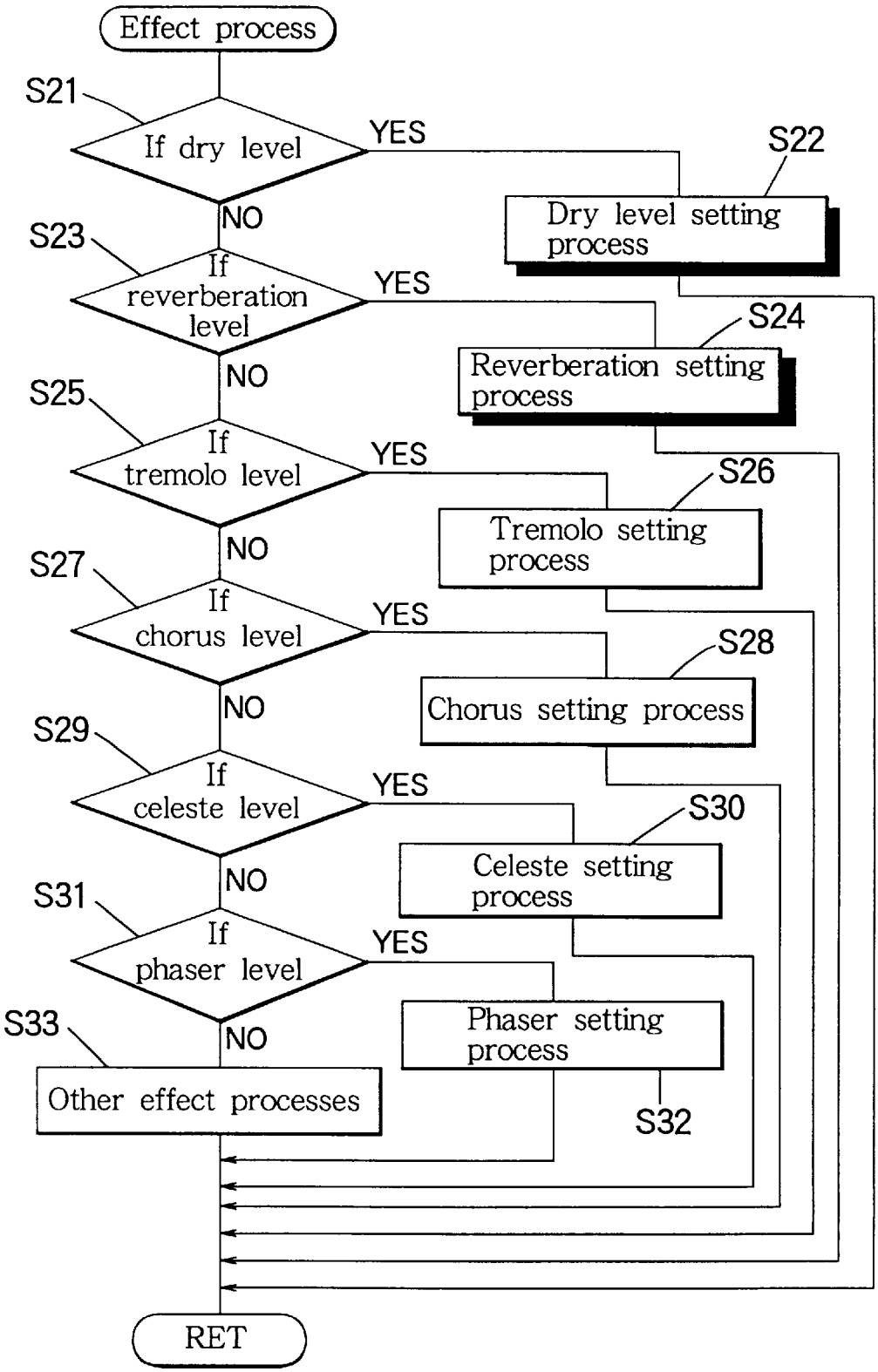
FIG. 5 is a flow chart showing a routine of effect process.

FIG. 5 shows a routine of the effect process called at the step S13 of FIG. 4. In this routine, the effect process is separately carried out for each MIDI channel. First, check is made at a step S21 as to if the effect data stored in the MIDI buffer indicates setting of the dry level as in the case (1). If the data indicates the setting of the dry level, a step S22 is undertaken to execute a dry level setting process, thereby returning. If it is judged at the step S21 that the data does not indicate the setting of the dry level, a step S23 is undertaken to check as to if the effect data indicates setting of the reverberation level as in the case (2). If the data indicates the setting of the reverberation level, a reverberation setting process is carried out at a step S24, thereby returning. If it is judged at the step S23 that the data does not indicate the setting of the reverberation level, a step S25 is undertaken to check as to if the effect data indicates setting of the tremolo level. If the data indicates the setting of the tremolo level, a tremolo setting process is carried out at a step S26, thereby returning. If it is judged at the step S25 that the effect data does not indicate the setting of the tremolo level, a step S27 is undertaken to check as to if the effect data indicates setting of the chorus level. If the data indicates the setting of the chorus level, a chorus setting process is undertaken at a step S28, thereby returning. If it is judged at the step S27 that the effect data does not indicate the setting of the chorus level, a step S29 is undertaken to check as to if the effect data indicates setting of the celeste level. If the data indicates the setting of the celeste level, a celeste setting process is undertaken at a step S30, thereby returning. If it is judged at the step S29 that the data does not indicate the setting of the celeste level, a step S31 is undertaken to check as to if the effect data indicates setting of the phaser level. If the data indicates the setting of the phaser level, a phaser setting process is carried out at a step S32, thereby returning. If it is judged at the step S31 that the data does not indicate the setting of the phaser level, other effect processes are executed in a step S33, thereby returning.

Figure 6:
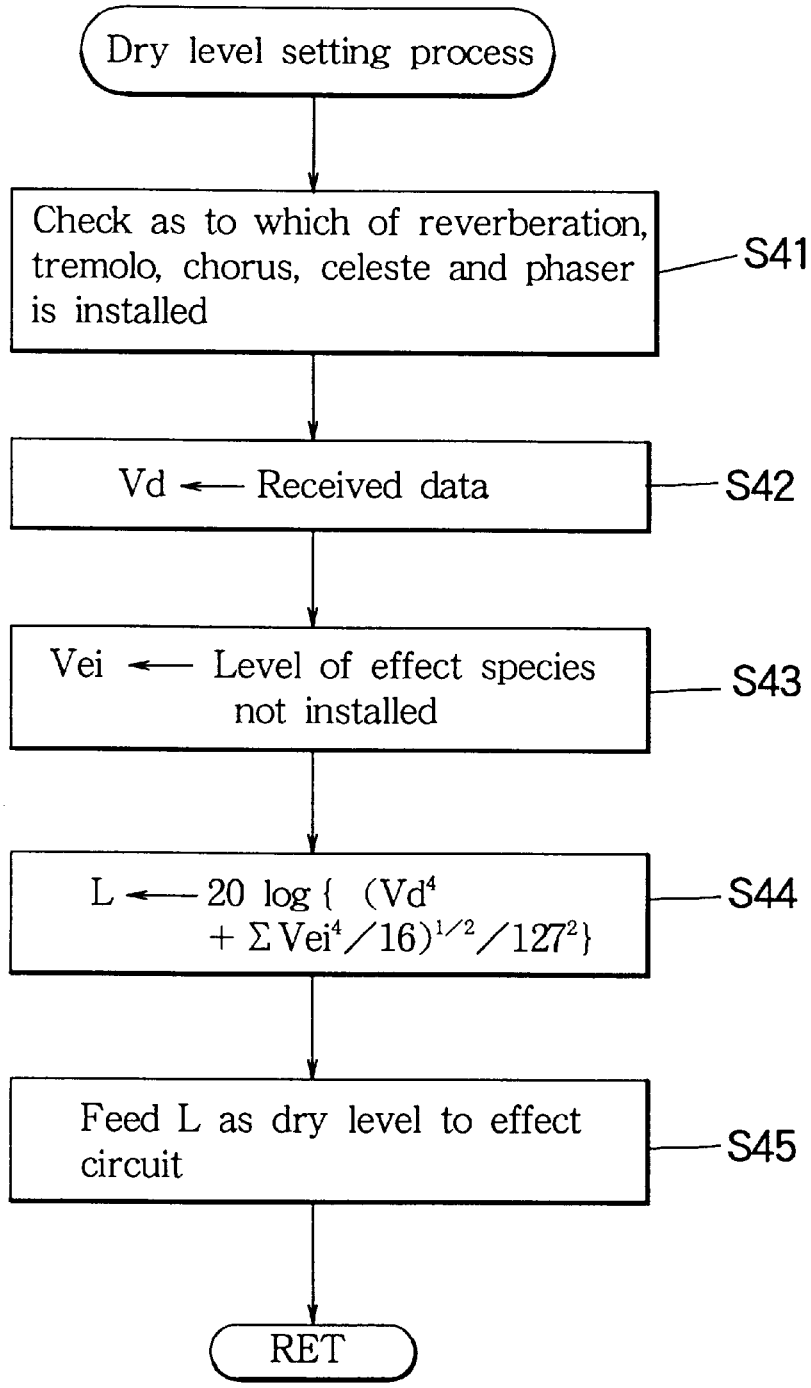
FIG. 6 is a flow chart showing a routine of dry level setting process.

FIG. 6 shows a routine of the dry level setting process executed at the step S22 of FIG. 5. First, check is made at a step S41 as to which of the reverberation, tremolo, chorus, celeste and phaser is installed in the internal effect circuit 7. Next, a step S42 is undertaken to set the received data of the dry sending level into a register Vd. Further, a step S43 is undertaken to set a level data of an absent effect species into a register Vei. In this embodiment, the celeste and the phaser are not installed so that the current celeste level is set in the register Ve1 and the phaser level is set in the register Ve2. Next, a step S44 is undertaken to compute $L=20\cdot\log\{(Vd^4+\Sigma Vei^4/16)^{1/2}/127^2\}$, which is indicated as the formula (1) in the case (1). In this embodiment, the term $\Sigma Vei^4$ is represented by $Ve1^4+Ve2^4$. If the total tone volume exceeds 0 dB, the resulting level is set to 0 dB. Next, a step S45 is undertaken to feed the calculated dry level L to the effect circuit 7. By this, the multiplication factor of the multiplier 21 is set according to the dry level L. The routine returns after the step S45.

Figure 7:
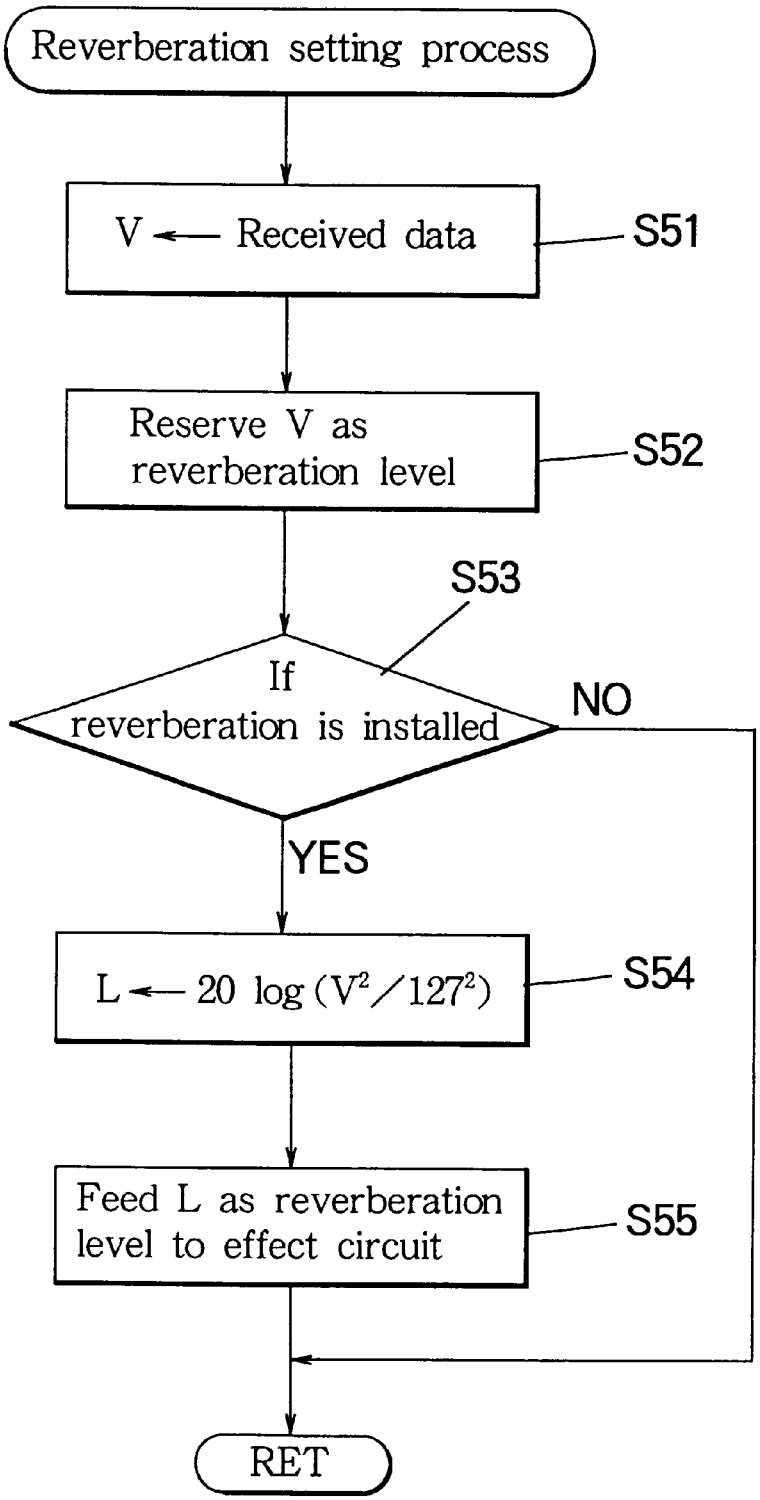
FIG. 7 is a flow chart showing a routine of reverberation setting process.

FIG. 7 shows a routine of the reverberation setting process executed in the step S24 of FIG. 5. First, a step S51 is undertaken to set the received data of the reverberation sending level into a register V. Next, a step S52 is undertaken to store the sending level V in a register as the reverberation level. The stored reverberation level may be used in the computation of an absent effect species in the step S43 of FIG. 6 if the reverberation is not installed in the internal effect circuit. Next, a step S53 is undertaken to check as to if the reverberation is installed in the internal effect circuit 7. If the reverberation is not installed, the routine simply returns. If the reverberation is installed, a step S54 is undertaken to calculate $L=20\cdot\log(V^2/127^2)$, which is presented as the formula (2) used in the case (2). Then, the calculated result L is fed to the effect circuit 7 as the reverberation level at a step S55. The routine returns after the step S55.

A similar routine is conducted as in the reverberation setting process of FIG. 7 for the tremolo setting process of the step S26 of FIG. 5, the chorus setting process of the step S28, the celeste setting process of the step S30 and the phaser setting process of the step S32. Namely, the received sending level of each effect species is set in the register V and another separate register. Further, check is made as to if each effect species is installed. If installed, the level L is calculated by the formula (2) as in the step S54. The calculated result is fed to the effect circuit 7 as the effect level. The present embodiment does not install the celeste and the phaser, hence the calculation and feeding process of the steps S54 and S55 is not actually executed in the celeste setting process of the step S30 and the phaser setting process of the step S32.

Next, detailed description is given for a routine of the remaining processes called at the step S13 of FIG. 4 in conjunction with FIGS. 8–12. First, concise description is given for various registers used in the following process routine.

(1) BSL[i]: register for storing LSB of a bank selector provided for each MIDI channel where an argument i denotes a corresponding MIDI channel
(2) BSM[i]: register for storing MSB of the bank selector provided for each MIDI channel where an argument i denotes a corresponding MIDI channel
(3) KC: register for storing a key code
(4) KEV: register for storing a kind of a key event, i.e., key-on or key-off
(5) KV: register for storing a key velocity
(6) LSD[i]: register for temporarily storing LSB of the bank selector provided for each MIDI channel where an argument i denotes a corresponding MIDI channel
(7) M: register for storing a master tuning data
(8) MCH: register for storing a MIDI channel number
(9) MSD[i]: register for temporarily registering MSB of the bank selector provided for each MIDI channel where an argument i denotes a corresponding MIDI channel
(10) mtun: register for storing a final calculated value of the master tuning
(11) mvol: register for storing a final calculated value of a master volume
(12) PC[i]: register for storing a code of a program change at each MIDI channel where an argument i denotes a corresponding MIDI channel
(13) PD[i]: register for temporarily storing a code of the program change at each MIDI channel where an argument i denotes a corresponding MIDI channel
(14) TCH: register for storing a vacant tone generating channel number
(15) VD[i]: register for temporarily storing a vibrato data for each MIDI channel where an argument i denotes a corresponding MIDI channel
(16) VDE: register for storing a final calculated value of the vibrato data for each MIDI channel
(17) VMin: register for storing a minimum modulation depth of the vibrato of each timbre
(18) VSens: register for storing a sensitivity of the vibrato of each timbre
(19) LBSL[i]: register for registering the last able LSB of the bank selector of each MIDI channel when the MSB of the bank selector is set to 00H where an argument i denotes a corresponding MIDI channel
(20) LPC[i]: register for registering the last able code of the program change when the MSB of the bank selector is set to 7FH where an argument i denotes a corresponding MIDI channel
(21) USER: flag used when a melody timbre is set other than MSB=00H for indicating whether the melody timbre is provided in the instrument. These registers are set to zero by the initialization.

Figure 8:
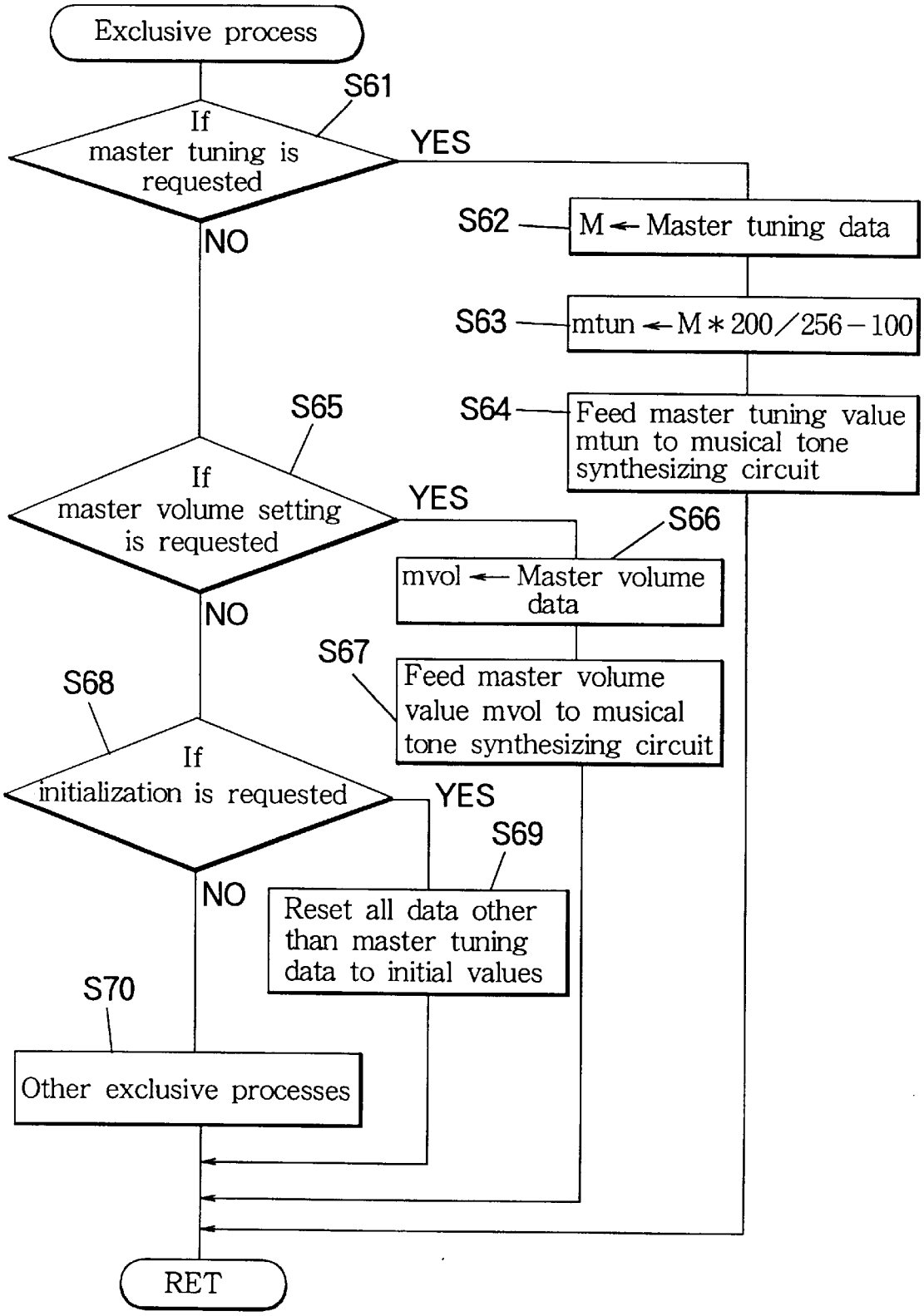
FIG. 8 is a flow chart showing a routine of exclusive process.

FIG. 8 shows a routine of an exclusive process called at the step S13 of FIG. 4. This exclusive process routine is executed when an exclusive message is received at the MIDI interface. First, check is made at a step S61 as to if the exclusive data in the MIDI buffer indicates setting of a master tuning. If the data indicates the master tuning, the received data of the master tuning is set in the register M at a step S62. The data ranges 00H through FFH, and a default value is set to 7FH. Next, a step S63 is undertaken to calculate a final value mtun of the master tuning according to the stored value of the register M. The mtun takes a value "−100" when the data of the register M is 00H, and takes a value of about "+100" when the data of the register M is 7FH. The value of the mtun is interpreted as a cent value so as to execute the setting of the master tuning in a range of upper and lower half tones around a standard pitch. Further, the value of the register mtun is fed to the musical tone synthesizing circuit at a step S64. Thereafter, the routine returns to the step S14 of FIG. 4. The musical tone synthesizing circuit may change the master tuning when the value of the mtun is received, or otherwise may change the master tuning when generating a first tone newly admitted after the receipt of the mtun.

If it is judged at the step S61 that the exclusive data does not indicate the setting of the master tuning, another check is made at a step S65 as to if the exclusive data indicates setting of the master volume. If the data indicates the setting of the master volume, the received data of the master volume is set in the register mvol at a step S66. The data ranges from 00H to 7FH. Next, the value of the register mvol is outputted to the musical tone synthesizing circuit at a step S67. A volume of each channel is instantly changed when the musical tone synthesizing circuit receives the master volume data, because the same must be processed in real time. Thereafter, the routine returns to the step S14 of FIG. 4.

If it is judged at the step S65 that the exclusive data does not indicate the setting of the master volume, a further check is made by a step S68 as to if the exclusive data indicates initialization. If the data indicates the initialization of the instrument system, a step S69 is undertaken to initialize various settings other than the master tuning. The electronic musical instrument can be used in ensemble performance in combination with a general acoustic instrument or a modified acoustic instrument driven by a MIDI signal. In such a case, a player must carry out final tuning among different instruments. Generally, the tuning requires a considerable time. However, once the tuning is achieved, another tuning is not required for a long period of time. On the other hand, the initialization of the system may be frequently carried out before sending new data at change of a music so as to erase unnecessary old data. In view of this, the initialization is executed except for the master tuning data. The initialization is conducted as follows:

Dry sending level ← 7FH
Each effect level ← 00H
Master volume ← 7FH
Program change ← 00H
Bank selector MSB ← 00H
Bank selector MSB ← 7FH (For MIDI channel 10 only)
Bank selector LSB ← 00H
Vibrato data ← 00H Thereafter, the routine returns to the step S14 of FIG. 4. If it is judged by the step S68 that the exclusive data does not indicate the initialization, other exclusive processes are carried out at a step S70, thereby returning to the step S14 of FIG. 4.

Figure 9:
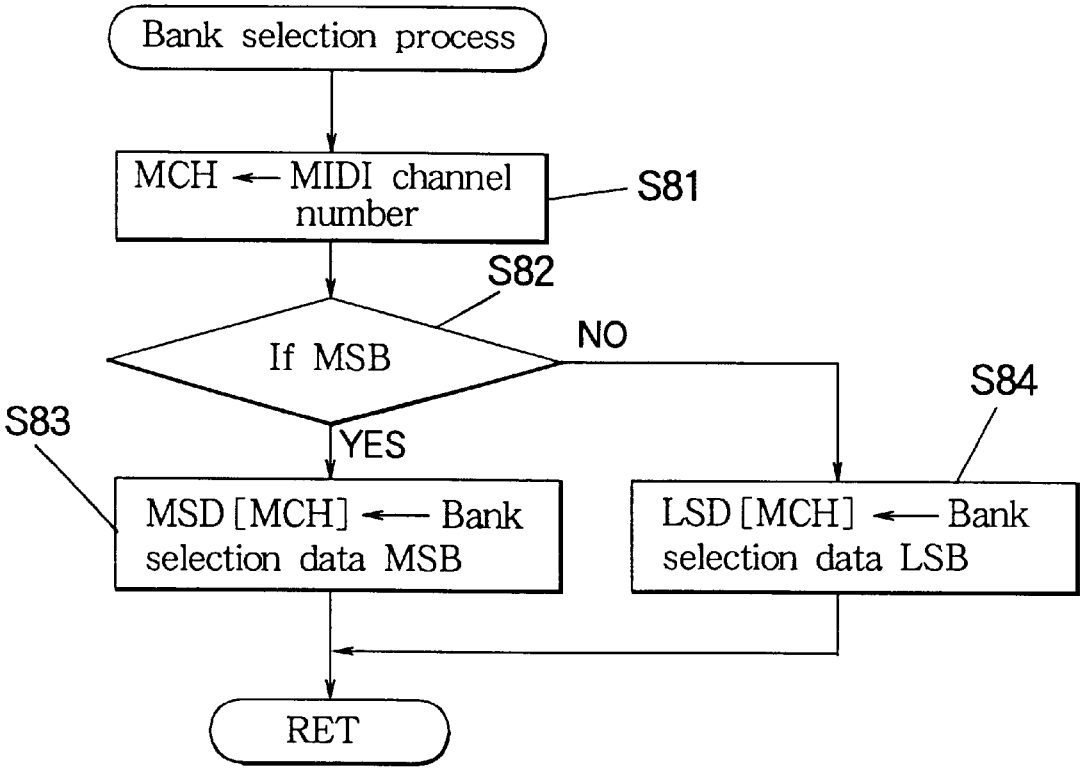
FIG. 9 is a flow chart showing a routine of bank selection process.

FIG. 9 shows a routine of a bank selection process involved in the step S13 of FIG. 4. The routine of the bank selection process is executed when a bank selection signal is admitted at the MIDI interface. The bank selector has a pair of parts MSB and LSB. The bank selector MSB is used for selection of a melody timbre, a rhythm timbre and a user timbre. The bank selector LSB represents extended parts of the melody timbre domain and the user timbre domain. First, a step S81 is undertaken to set a MIDI channel number contained in the received bank selection signal to the register MCH. Then, check is made at a step S82 as to whether the received bank selection signal is related to the MSB part. If the received data indicates the MSB part, a step S83 is undertaken to store the received bank selection data into the temporary register MSD of the corresponding MIDI channel, thereby returning. If it is judged by the step S82 that the received bank selection signal does not indicate the MSB part, i.e., does indicate the LSB part, a subsequent step S84 is undertaken to store the received bank selection data into the temporary register LSD. Thereafter, the routine returns. An actual bank selection is effected when a program change signal is received as will be described later. For this, the received bank selection data is once stored in either of the temporary registers MSD and LSD.

Figure 10:
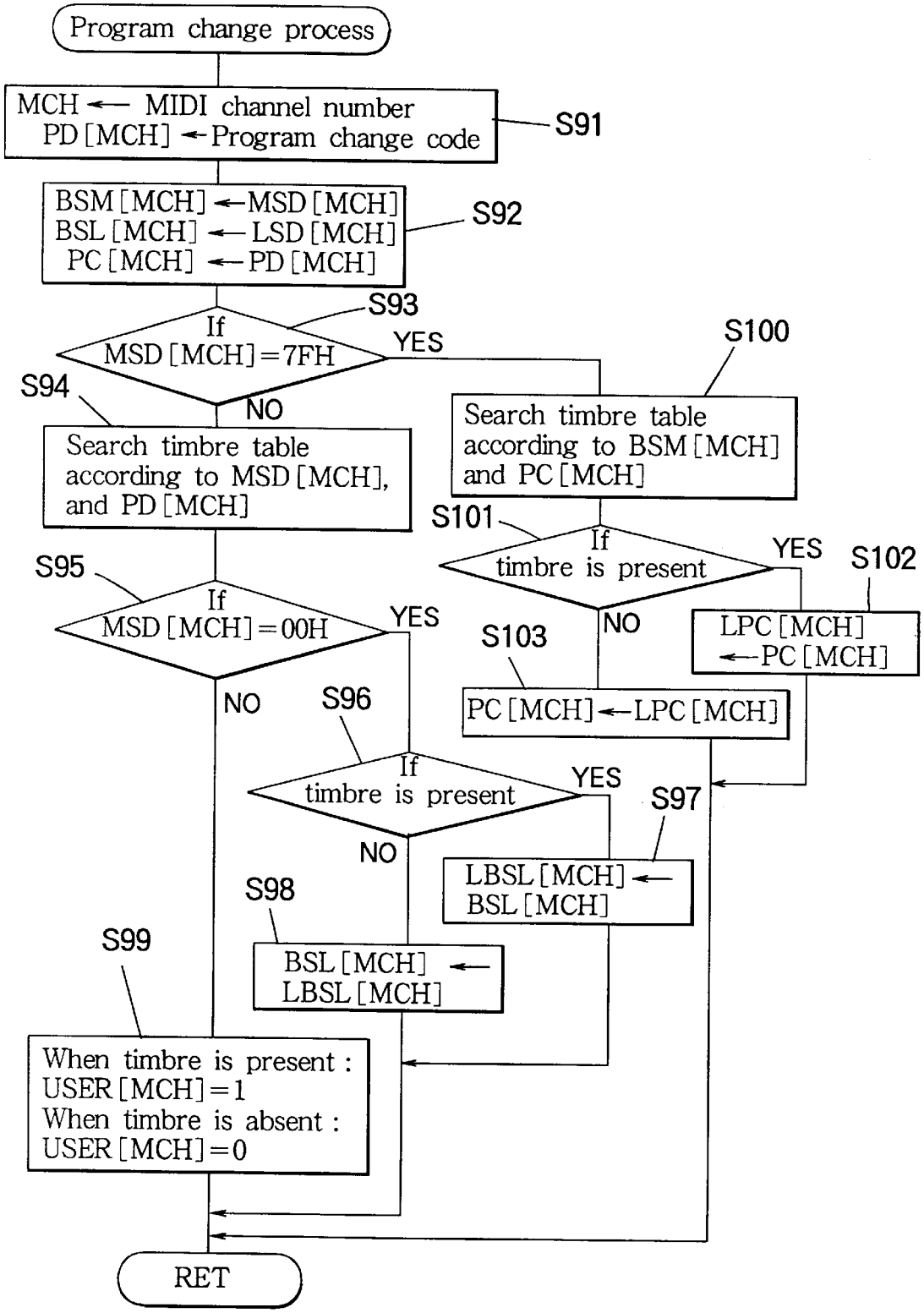
FIG. 10 is a flow chart showing a routine of program change process.

FIG. 10 shows a routine of the program change process called at the step S13 of FIG. 4. The routine of the program change process is executed when the program change signal is admitted through the MIDI interface. First, a step S91 is undertaken to set a MIDI channel number of the received program change signal into the register MCH, and to store a code of the program change into the temporary register PD[MCH]. Then, a step S92 is undertaken to transfer the received bank selection data, and the program change data to the register BSM[MCH] or BSL[MCH], and the register PC[MCH], respectively, for feeding a tone generator of the musical tone synthesizing circuit.

Next, check is made at a step S93 as to if the bank selection data MSB assigned to the concerned MIDI channel indicates 7FH. If 7FH is indicated, it is judged that a rhythm timbre is assigned to that MIDI channel. As will be described below, the program change data and the bank selection data are differently interpreted between the rhythm timbre and the melody timbre. If the melody timbre is assigned to the MIDI channel, a step S94 is undertaken to search a melody timbre table according to the bank selection data MSB and LSB of the channel MCH stored in the registers MSD[MCH] and LSD[MCH], and according to the program change data of the channel MCH stored in the register PD[MCH]. The melody timbre table is written with addresses of a memory area of actual musical tone data, by which a check can be made as to if a requested timbre exists or not. Then, a subsequent step S95 is undertaken to check as to if the bank selection data MSB indicates 00H. In case of 00H, it is judged that the designated melody timbre is one selected from a set of common timbres which can commonly used in different models of instruments. Then, a timbre replacement process is conducted in a step S96 and further steps. All models of the instruments adopting the common timbres may not install every timbre species or variations due to grade differences. Where the set of the common timbres are adopted, a particular one of the common timbres is selected by the program change. Further, one variation of the selected timbre is specified by the bank selection data LSB. Therefore, a high performance model may have diverse variations by an extension of LSB, while a cheap model may have a plain set of the common timbres. In such a case, all members generate timbres according to an identical code of the program change so as to prevent an inconsistency in the generated timbres. Thus, if the designated timbre belongs to the set of the common timbres, a variation corresponding to the last confirmed LSB of the bank selector is actually generated as follows. Namely, the step S96 is undertaken to check as to if the designated timbre exists according to the searched result of the step S94. If the timbre exists, musical tones can be generated according to the information which is set by the step S92. Consequently, a step S97 is undertaken to set the bank selection data BSL without any change into the register LBSL which indicates the last confirmed variation of the timbre. Thereafter, the routine returns. If it is judged at the step S96 that the exact timbre variation does not exist, a subsequent step S98 is undertaken to replace the bank selection data LSB which is set by the step S92 by the last confirmed data or the able data LBSL which is previously designated and set by the step S97. Thereafter, the routine returns. By such a manner, in case that the bank selection data MSB indicates 00H, the replacement of the timbre is achieved by the bank selection data LSB. The register LBSL stores the last bank selection data LSB which is confirmed effective in a corresponding MIDI channel when MSB=00H is inputted. Therefore, by the replacement process of the step S98, when a currently designated timbre does not exist, the last able timbre substitutes the received unable timbre.

Figure 14:
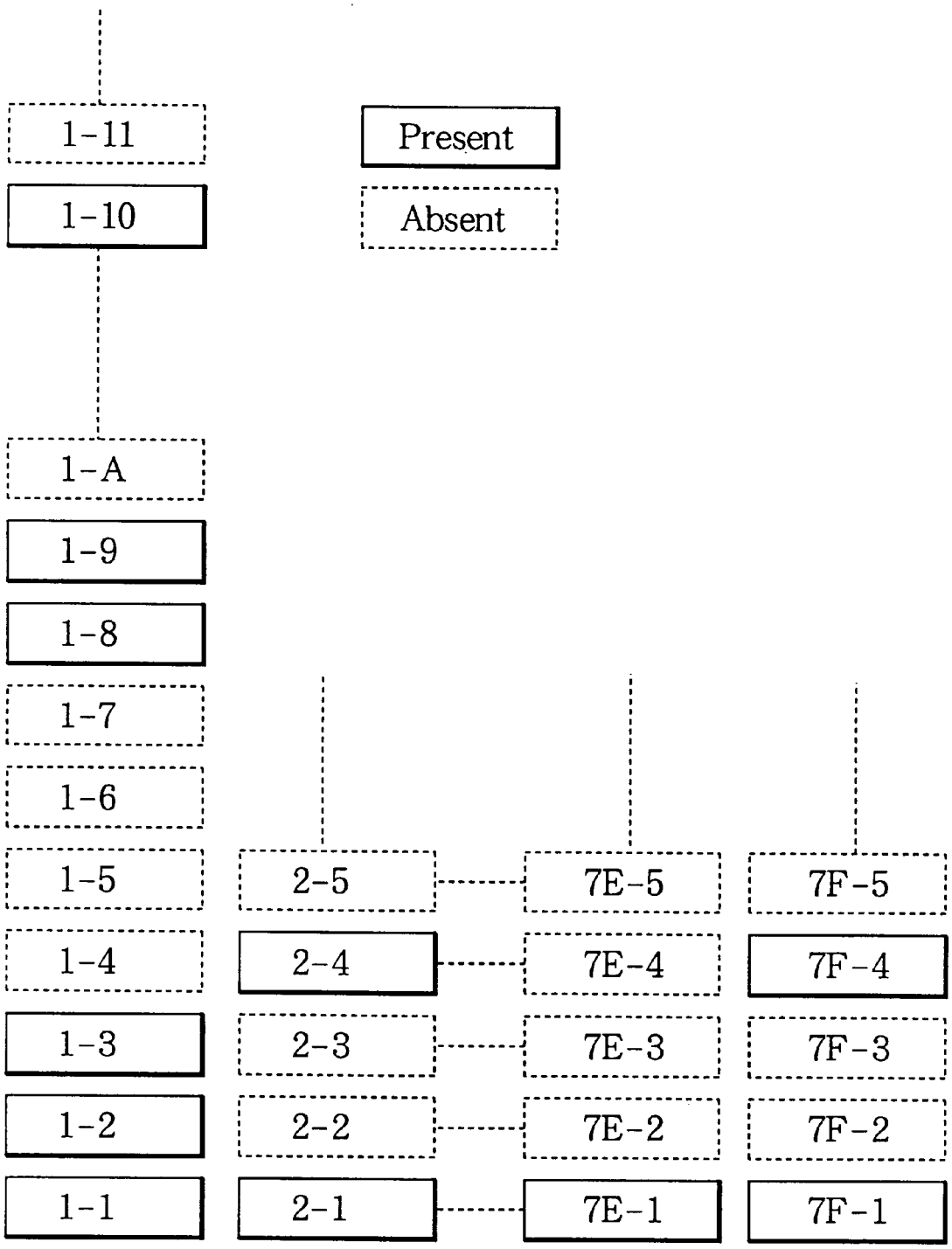
FIG. 14 is a schematic diagram of a timbre table which lists timbres installed in the embodiment of the electronic musical instrument.

Concrete description is given for the above timbre replacement operation in conjunction with FIG. 14. In the figure, each block labeled by 1-x indicates a melody timbre.

The solid block indicates an able timbre installed in the electronic musical instrument, while the dashed block indicates an unable timbre which is not installed in the electronic musical instrument. Variations of the timbre is grouped by domains of the blocks. In the FIG. 14 example, the blocks 1-1 to 1-7 represent variations of a standard timbre, the blocks 1-8 to 1-F represent variations of a bright timbre, and the blocks 1-10 to 1-17 represent variations of a dark timbre. If a transmitting electronic musical instrument registers the timbre 1-11, the transmitting electronic musical instrument transmits first timbre designation information which specifies a similar timbre 1-10, and then transmits second timbre designation information which specifies the exact timbre 1-11. A receiving electronic musical instrument successively receives the first and second timbre designation information as described in the flow charts. However, the receiving instrument does not install the timbre can, hence the last able timbre 1-10 is set in place of the timbre 1-11. By such a manner, if timbre substitution is expected, different timbre designation information is successively transmitted to enable the receiving instrument to select optimum one from the registered timbres. In the above example, the timbre replacement is commanded to designate a variation of the dark timbre. In such a case, if the receiving instrument is not installed with the timbre 1-10, a last able timbre can replace the missing timbre 1-10 as a matte r of sequence.

Referring back to FIG. 10, description continues for the program change process. If it is judged by the step S95 that the bank selection data MSB does not indicate 00H, the set of the common timbres is not selected, but another set of unique timbres is selected, which is unique to an individual model of the instrument. In this cased the replacement or substitution of the timbre cannot be carried out unlike the common timbres. Therefore, if the selected timbre exists, the musical tone is generated according to the existing timbre. If the selected timbre does not exist, the generation of the musical tone is suspended. Further, assignment of a tone generation channel may be prohibited to avoid wasteful use of the tone generation channels. Namely, a step S99 is undertaken to set the register USER according to the search result of the step S94. The register USER is utilized in the tone generation process as will be described later. In case of USER=0, the assignment of the tone generation channel is inhibited at all.

Referring back to the step S93, if it is judged that the register MSD indicates 7FH, a step S100 is undertaken to search if a corresponding timbre exists in a rhythm timbre table according to the register BSM which stores the bank selection data MSB of the MIDI channel MCH, and according to the register PC which temporarily stores the program change code. With regard to the rhythm timbre, a variation can be selected according to the program change rather than the bank selection data LSB in contrast to the melody timbre. If it is judged at a step S101 that the designated timbre exists, the musical tone is generated according to the program change code PC which is set in the step S92. Further, the set PC is reserved in the register LPC at a step S102 for possible timbre substitution. If it is judged that the designated timbre does not exist, a step S103 is undertaken to replace or substitute the program change code which is set at the step S92 by the able program change code LPC which is confirmed effective. Thereafter, the routine returns.

As described above, the bank selection data MSB is utilized to conduct a general selection between the melody timbre and the rhythm timbre, or among the user timbres unique to models. Particularly, the bank selection data MSB=00H indicates the common timbre which is common to different models, and the bank selection data MSB other than 00H indicates the unique timbre which is unique to an individual model. Consequently, in case of the common timbre, the timbre substitution is definitely conducted by selecting a bank which is confirmed effective just before the replacement. In case of the unique timbre, the timbre substitution is not conducted, but the tone generation is suspended so as to avoid inconsistent change of the timbre. The bank selection data LSB designates a specific variation within a generic timbre, and therefore the change of LSB does not cause serious affects. In case of the rhythm timbre where the bank selection data MSB=7FH, the timbre is not selected by the bank selection data LSB, but is selected by the program change code and the key code. In this case, the program change code of the rhythm timbre is treated in manner similar to the bank selection data LSB of the melody timbre.

Figure 11:
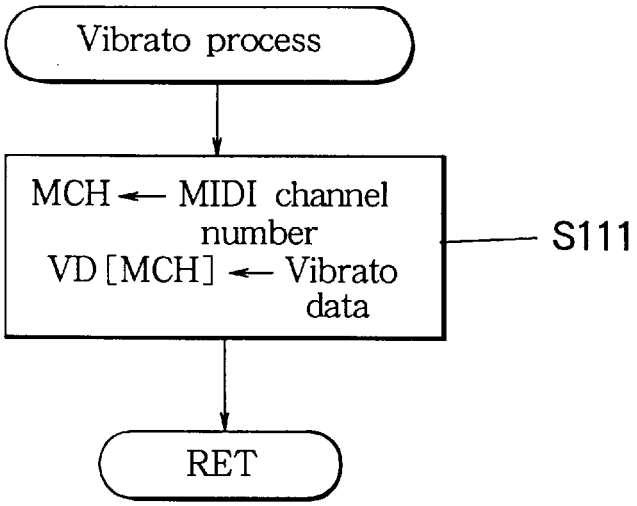
FIG. 11 is a flow chart showing a routine of vibrato process.

FIG. 11 shows a routine of the vibrato process called at the step S13 of FIG. 4. The vibrato process routine is executed when a vibrato data is received by the MIDI interface. In the vibrato process routine, a step S111 is undertaken to set a MIDI channel number involved in the received program change message into the register MCH, and to set the vibrato data into the register VD[MCH]. Thereafter, the routine returns to the step S14 of FIG. 4. In this embodiment, the vibrato data is simply reserved in the register at the time of the receipt thereof. The reserved data is actually used as vibrato information when the corresponding MIDI channel admits a command for tone generation. Otherwise, the vibrato information may be fed to the musical tone synthesizing circuit through this routine to execute the vibrato process in real time.

Figure 12:
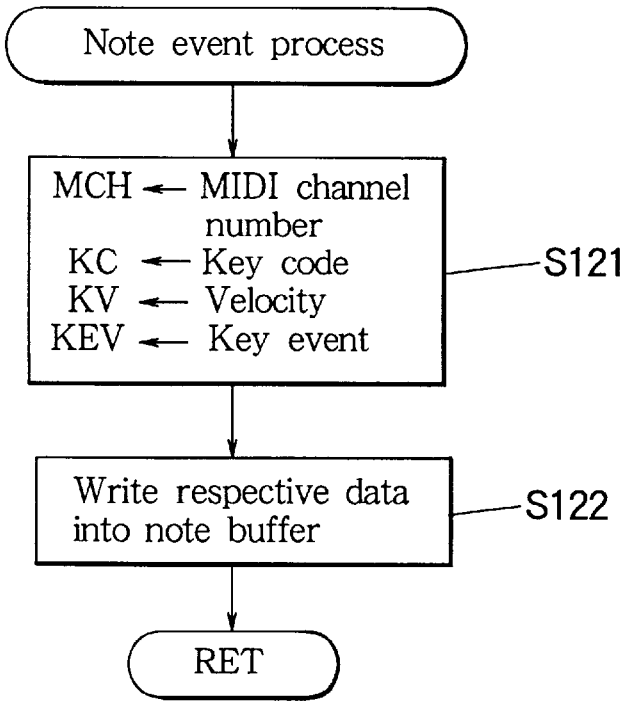
FIG. 12 is a flow chart showing a routine of note event process.

FIG. 12 shows a routine of the note event process called at the step S13 of FIG. 4. The note event process routine is executed when the MIDI interface receives a note event data. First, a step S121 is undertaken to set a MIDI channel code involved in the received program change message into the register MCH, and to set the received information including a key code, a velocity and a key event into the registers KC, KV and KEV, respectively. The register KEV is written with a key-on message KON or a key-off message KOFF. Then, the set information is reserved in the note buffer at a step S122, thereby returning to the step S14 of FIG. 4.

Figure 15:
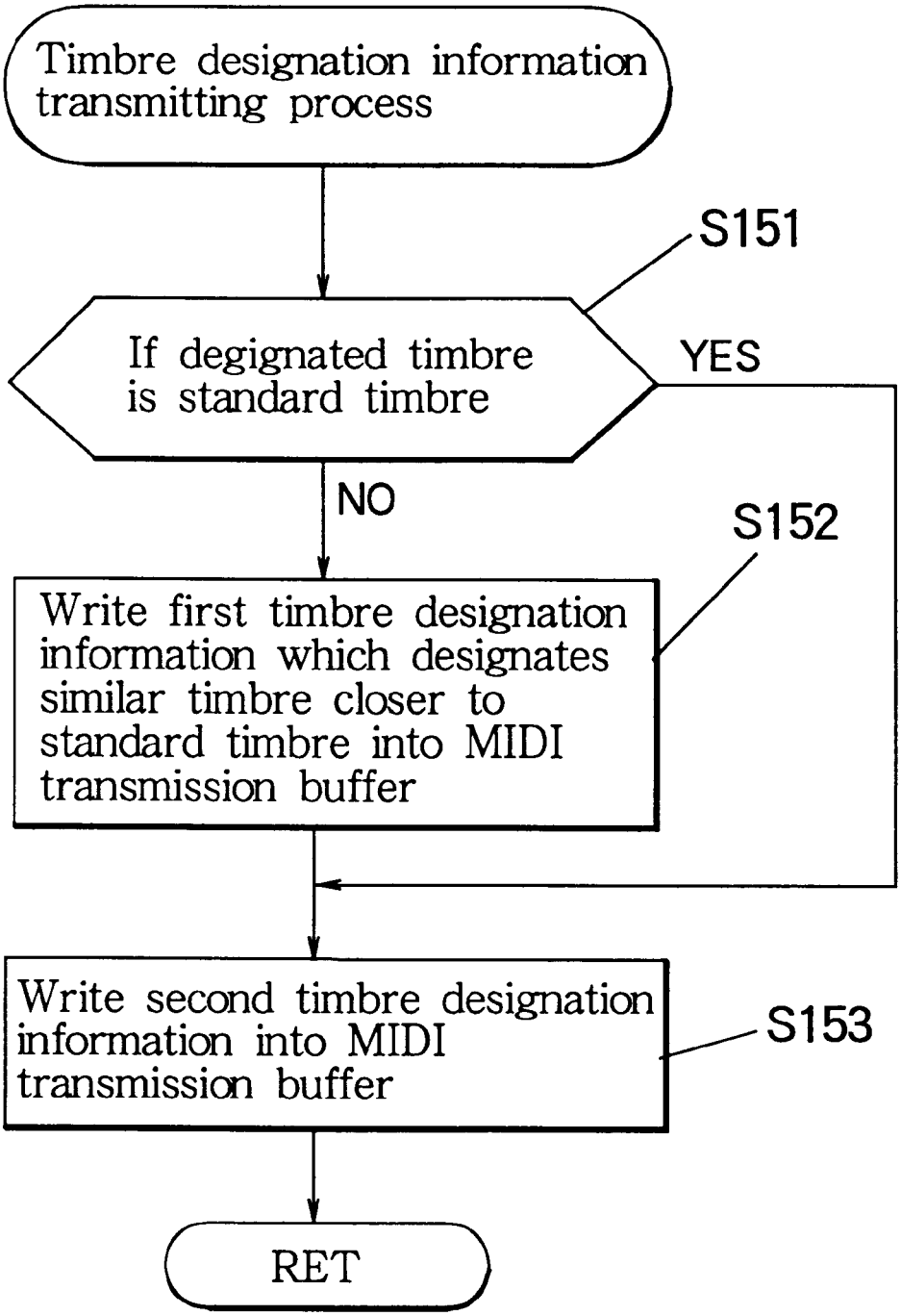
FIG. 15 is a flow chart showing a routine of timbre designation information transmitting process.

FIG. 15 shows a routine of the timbre designation information transmission process which is called at the step S17 of FIG. 4. The routine of the timbre information transmitting process is executed under the condition where a timbre switch of the operation panel is actuated by the player and the inputted timbre setting can be fed externally. First, a step S151 is undertaken to check as to if the timbre designation information to be transmitted designates a standard timbre of a generic nature which is expected to be registered in every instrument. If it is expected that a desired object timbre to be transmitted may not be installed in a receiving party, a subsequent step S152 is undertaken to select a substitute timbre which is similar to the object timbre and which is closer to a standard or typical timbre than the object timbre, and to write preceding timbre designation information into the MIDI transmission buffer so as to designate that definite timbre. Next, a step S153 is undertaken to write succeeding timbre designation information into the MIDI transmission buffer so as to designate the indefinite or uncertain object timbre. By this, as described before, the receiving party can carry out the timbre replacement if the object timbre is not installed such that the superior object timbre is replaced by the close inferior timbre, not a fixed timbre. If it is expected by the step S151 that the object timbre is definitely installed in other instruments, a step S153 is directly undertaken to write the sole timbre designation information into the MIDI transmission buffer.

Figure 13:
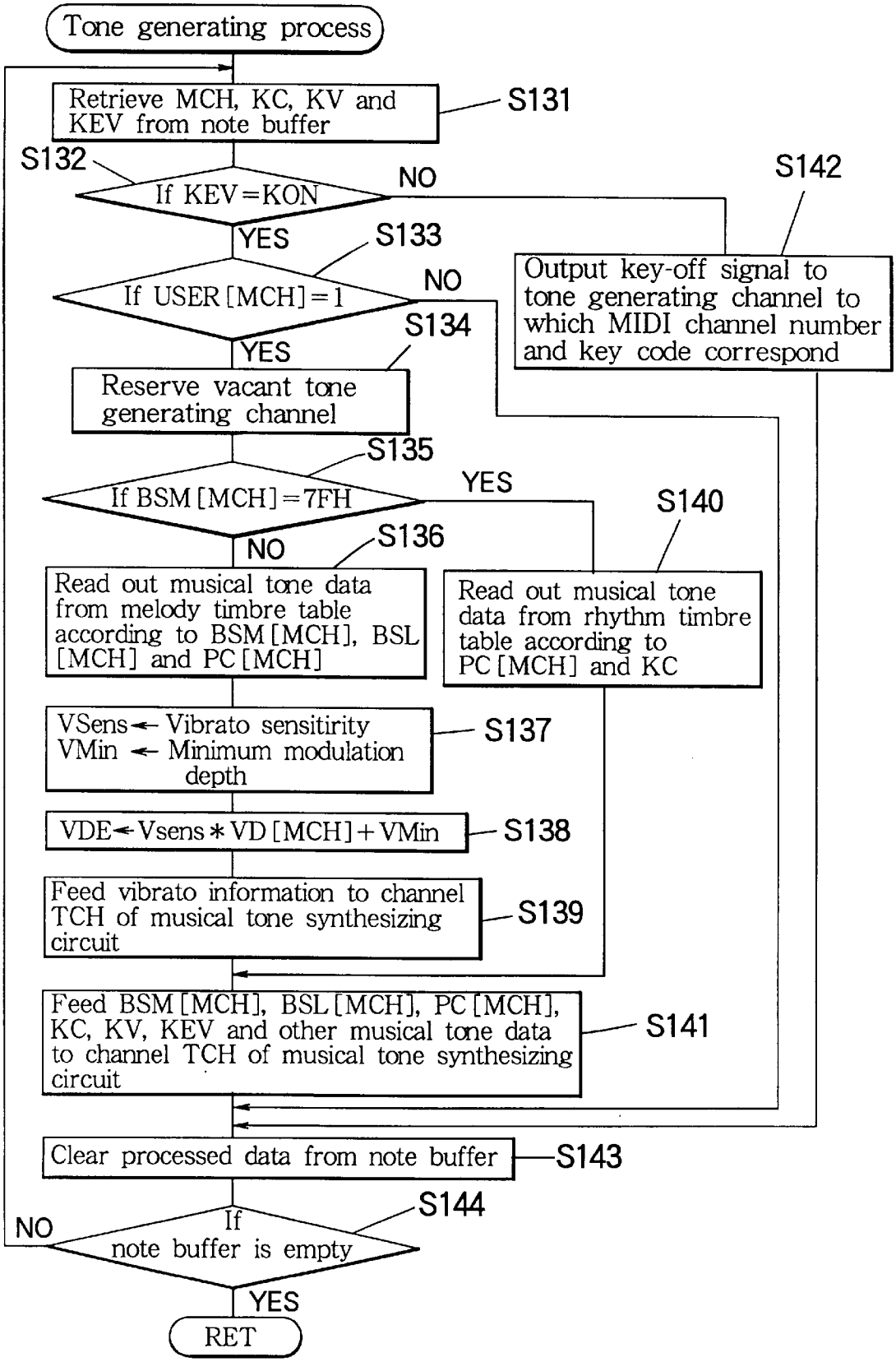
FIG. 13 is a flow chart showing a routine of tone generating process.

As described above in conjunction with FIGS. 5–12, the data inputted into the MIDI interface is processed according to the event nature of the inputted data by the FIG. 4 routine of the MIDI interface process. If there is no data to be processed in the MIDI buffer, the routine returns to the step S3 of FIG. 3 to execute the tone generation process. FIG. 13 shows a routine of the tone generating process executed at the step S3 of FIG. 3. In the routine of the tone generating process, a first step S131 is undertaken to retrieve the various data written in the note buffer by the step S122 of FIG. 12. Next, check is made at a step S132 as to if the retrieved event data indicates a KON event. If it is judged that the retrieved data indicates the KON event, subsequent check is made at a step S133 as to if the register USER indicates "1". If the register USER does not indicate "1", i.e., USER=0, the routine jumps to a step S143 to inhibit the assignment of the specified MIDI channel because the instrument does not install the designated user timbre. If the register USER indicates "1", the routine advances to a step S134. In this step, a vacant tone generation channel is reserved for generating the key-on event. The reserved channel number is set in the register TCH. Subsequently, check is made at a step S135 as to if the rhythm timbre is designated (i.e., BSM=7FH) for the MIDI channel specified for the tone generation. In case that BSM is other than 7FH, it is judged that the melody timbre is assigned to the specified MIDI channel. In such a case, the routine proceeds to a step S136. In this step, a musical tone data is retrieved from the melody timbre table according to the bank selection data and the program change data. The retrieved musical tone data includes a memory address of a timbre waveform, envelope information, vibrato information, effect information, tone volume balance information and so on. At a next step S137, the retrieved vibrato sensitivity is set in the register VSens, and the minimum modulation depth is set in the register VMin. In a step S138, the actual vibrato value VDE is computed according to these values VSens and VMin. At a step S139, the vibrato information is fed to the musical tone synthesizing circuit. The routine proceeds to a step 5141 after the step S139. If it is judged at the step S135 that the register BSM indicates 7FH, the rhythm timbre is assigned. In this case, a step S140 is undertaken to retrieve the musical tone data from the rhythm timbre table according to the program change code and the key code, thereby advancing to the step S141. By such a manner, the retrieved musical tone data is fed to the musical tone synthesizing circuit at the step S141 so as to initiate generation of the musical tone. Referring back to the step S132, if the event is not the key-on event KON but the key-off event, the routine branches to a step S142 where a key-off signal is fed to a corresponding tone generating channel, thereby advancing to the step S143. The processed data is cleared from the note buffer at the step S143. Further, if it is judged at a step S144 that another data remains in the note buffer, the routine returns to the step S131 to thereby continue the tone generation process.

In the present embodiment, when the received timbre designation information designates an absent timbre, a previously designated and confirmed present timbre is selected in place of the designated absent timbre. However, alternatively, the absent timbre may be substituted by a common timbre which is commonly installed in every instrument. This is realized by setting "0" to the value BSL at the step S98 of FIG. 10. Further, the rhythm timbre may be subjected to a similar replacement. In such a case, the value PC is set with "0" at the step S103, since the program change PC of the rhythm timbre is equivalent to the bank selection LSB of the melody timbre.

As described above, according to the invention, if the received timbre information designates an absent or unable timbre which is not installed, another present or able timbre which is previously or precedingly conformed effective is selected to substitute the absent timbre. Therefore, the absent timbre is not replaced by a fixed timbre, but can be replaced by a variable timbre which is previously designated by preceding information, thereby achieving extended replacement of the timbre in contrast to the prior art.

What is claimed is:

1. An electronic musical apparatus comprising:

tone generating means for generating a musical tone in accordance with a selected one of a plurality of installed timbres;

receiving means for receiving timbre designation information identifying a desired timbre from an external source;

determining means for determining if the desired timbre corresponds to one of the plurality of installed timbres;

installed timbre identification memory means for storing said received timbre designation information if said determining means determines that the desired timbre corresponds to one of the plurality of installed timbres;

selecting means for selecting, if the determining means determines that the desired timbre corresponds to one of the plurality of installed timbres, the corresponding installed timbre; and substitute means for selecting, if the determining means determines that the desired timbre does not correspond to one of the plurality of installed timbres, a substitute timbre corresponding to timbre identification information previously received by said receiving means and stored in said installed timbre identification memory.

2. An electronic musical apparatus comprising:

tone generating means for generating a musical tone signal in accordance with a selected one of a plurality of installed timbres;

receiving means for receiving timbre designation information which designates at least a first timbre and a second timbre for a musical tone signal; and selecting means for selecting the second timbre if the second timbre corresponds to one of the plurality of installed timbres and selecting the first timbre in place of the second timbre from the installed timbres if the second timbre does not correspond to one of the plurality of installed timbres, wherein the tone generating means generates a musical tone signal in accordance with the first timbre in place of the second timbre when the second timbre is not present in the plurality of installed timbres.

3. An electronic musical apparatus according to claim 2 wherein the first timbre is a timbre commonly installed in electronic musical instruments and the second timbre is a unique timbre not commonly installed in electronic musical instruments.

4. An electronic musical apparatus according to claim 2 wherein the first timbre is a generic timbre commonly installed in electronic musical instruments and the second timbre is a variation of the first timbre.

5. An electronic musical apparatus according to claim 2 wherein the timbre designation information comprises first information designating the first timbre and second information designating the second timbre, and the first information is received before the second information, and the second timbre has a higher priority than the first timbre.

6. An electronic musical apparatus according to claim 2, wherein the receiving means receives the timbre designation information from an external source.

7. A system comprising:

a first electronic musical apparatus comprising first tone generating means for generating a musical tone in accordance with a selected one of a first plurality of installed timbres;

a second electronic musical apparatus comprising second tone generating means for generating a musical tone in accordance with a selected one of a second plurality of installed timbres, wherein at least the first electronic musical apparatus further comprises transmitting means for transmitting first timbre designation information which designates a desired timbre and second timbre designation information which designates an alternate timbre, and at least the second electronic musical apparatus further comprises receiving means for receiving the first timbre designation information and the second timbre designation information, and selecting means for selecting the alternate timbre designated by the second timbre designation information if the desired timbre designated by the first timbre designation information does not correspond to one of the second plurality of installed timbres.

8. A method for use in an electronic musical apparatus having a plurality of installed timbres comprising:

receiving timbre designation information identifying a desired timbre from an external source;

determining if the desired timbre corresponds to one of the plurality of installed timbres;

storing the received timbre designation information in an installed timbre identification memory if the determining means determines that the desired timbre corresponds to one of the plurality of installed timbres;

selecting, if the desired timbre corresponds to one of the plurality of installed timbres, the corresponding installed timbre; and selecting, if the desired timbre does not correspond to one of the plurality of installed timbres, a substitute timbre corresponding to timbre identification information previously received and stored in the installed timbre identification memory.

9. A storage medium readable by a processor having a plurality of installed timbres, and containing instructions for causing said processor to perform the method comprising the steps of:

receiving timbre designation information identifying a desired timbre from an external source;

determining if the desired timbre corresponds to one of the plurality of installed timbres;

storing the received timbre designation information in an installed timbre identification memory if the determining means determines that the desired timbre corresponds to one of the plurality of installed timbres;

selecting, if the desired timbre corresponds to one of the plurality of installed timbres, the corresponding installed timbre; and selecting, if the desired timbre does not correspond to one of the plurality of installed timbres, a substitute timbre corresponding to timbre identification information previously received and stored in the installed identification memory.

10. A method for use in an electronic musical apparatus having a plurality of installed timbres comprising:

receiving timbre designation information which designates at least a first timbre and a second timbre for a musical tone signal;

selecting the second timbre if the second timbre corresponds to one of the plurality of installed timbres; and selecting the first timbre in place of the second timbre from the plurality of installed timbres if the second timbre does not correspond to one of the plurality of installed timbres, wherein, when the second timbre is not present in the plurality of installed timbres, a musical tone signal is generated in accordance with the first timbre in place of the second timbre.

11. A method according to claim 10 wherein the first timbre is a timbre commonly installed in electronic musical instruments and the second timbre is a unique timbre not commonly installed in electronic musical instruments.

12. A method according to claim 10 wherein the first timbre is a generic timbre commonly installed in electronic musical instruments and the second timbre is a variation of the first timbre.

13. A method according to claim 10 wherein the timbre designation information comprises first information designating the first timbre and second information designating the second timbre, and the first information is received before the second information, and the second timbre has a higher priority than the first timbre.

14. A method according to claim 10 wherein the step of receiving receives the timbre designation information from an external source.

15. A storage medium readable by a processor having a plurality of installed timbres, and containing instructions for causing said processor to perform the method comprising the steps of:

receiving timbre designation information which designates at least a first timbre and a second timbre for a musical tone signal;

selecting the second timbre if the second timbre corresponds to one of the plurality of installed timbres; and selecting the first timbre in place of the second timbre from the plurality of installed timbres if the second timbre does not correspond to one of the plurality of installed timbres, wherein, when the second timbre is not present in the plurality of installed timbres, a musical tone signal is generated in accordance with the first timbre in place of the second timbre.

16. A storage medium according to claim 15, wherein the first timbre is a timbre commonly installed in electronic musical instruments and the second timbre is a unique timbre not commonly installed in electronic musical instruments.

17. A storage medium according to claim 15, wherein the first timbre is a generic timbre commonly installed in electronic musical instruments and the second timbre is a variation of the first timbre.

18. A storage medium according to claim 15, wherein the timbre designation information comprises first information designating the first timbre and second information designating the second timbre, and the first information is received before the second information, and the second timbre has a higher priority than the first timbre.

19. A method for use in a system comprising a first electronic musical apparatus and a second musical apparatus having a plurality of installed timbres comprising:

transmitting first timbre designation information which designates a desired timbre and second timbre designation information which designates an alternate timbre from the first electronic musical apparatus;

receiving the first timbre designation information and the second timbre designation information at the second electronic musical apparatus;

determining whether the desired timbre designated by the first timbre designation information corresponds to one of the plurality of installed timbres; and selecting, at the second electronic musical instrument, the substitute timbre designated by the second timbre designation information if the desired timbre designated by the first timbre designation information does not correspond to one of the plurality of installed timbres.

20. A storage medium readable by a processing system comprising a first electronic musical apparatus and a second musical apparatus having a plurality of installed timbres, the storage medium containing instructions for causing said system to perform the method comprising the steps of:

transmitting first timbre designation information which designates a desired timbre and second timbre designation information which designates an alternate timbre from the first electronic musical apparatus;

receiving the first timbre designation information and the second timbre designation information at the second electronic musical apparatus;

determining whether the desired timbre designated by the first timbre designation information corresponds to one of the plurality of installed timbres; and selecting, at the second electronic musical instrument, the substitute timbre designated by the second timbre designation information if the desired timbre designated by the first timbre designation information does not correspond to one of the plurality of installed timbres.

21. An electronic musical apparatus comprising:

first designating means for designating first timbre information associated with a first timbre;

determining means for determining whether the first timbre corresponds to one of a plurality of predetermined timbres;

selecting means for selecting one of the plurality of predetermined timbres that is similar to the first timbre if the determining means determines that the first timbre does not correspond to one of the plurality of predetermined timbres;

second timbre designating means for designating second timbre information corresponding to the timbre selected by the selecting means if the selecting means selects a timbre; and transmitting means for transmitting the first timber information to another electronic musical apparatus and for transmitting the second timbre information to the other electronic musical apparatus if the second timbre designating means designates second timbre information.

22. A musical instrument apparatus according to claim 21 wherein the selecting means selects one of the plurality of predetermined timbres that is most similar to the first timbre.

23. A musical instrument apparatus according to claim 21 wherein the selecting means selects one of the plurality of predetermined timbres that is similar to the first timbre within a predetermined threshold.

24. A method for use in an electronic musical apparatus comprising:

designating first timbre information associated with a first timbre;

determining whether the first timbre corresponds to one of a plurality of predetermined timbres;

selecting one of the plurality of predetermined timbres that is similar to the first timbre if the first timbre does not correspond to one of the plurality of predetermined timbres;

designating second timbre information corresponding to the selected timbre if the first timbre does not correspond to one of the plurality of predetermined timbres;

transmitting the second timbre information to another electronic musical apparatus if the first timbre does not correspond to one of the plurality of predetermined timbres; and transmitting the first timber information to the other electronic musical apparatus.

25. A method according to 24 claim wherein the selecting step selects one of the plurality of predetermined timbres that is most similar to the first timbre.

26. A method according to claim 24 wherein the step selects one of the plurality of predetermined timbres that is similar to the first timbre within a predetermined threshold.

27. A storage medium readable by a processor and containing instructions for causing said processor to perform the method of comprising the steps of:

designating first timbre information associated with a first timbre;

determining whether the first timbre corresponds to one of a plurality of predetermined timbres;

selecting one of the plurality of predetermined timbres that is similar to the first timbre if the first timbre does not correspond to one of the plurality of predetermined timbres;

designating second timbre information corresponding to the selected timbre if the first timbre does not correspond to one of the plurality of predetermined timbres;

transmitting the second timbre information to another electronic musical apparatus if the first timbre does not correspond to one of the plurality of predetermined timbres; and transmitting the first timbre information to the other electronic musical apparatus.

28. A storage medium according to claim 27, wherein the selecting step selects one of the plurality of predetermined timbres that is most similar to the first timbre.

29. A storage medium according to claim 27, wherein the selecting step selects one of the plurality of predetermined timbres that is similar to the first timbre within a predetermined threshold.

30. An electronic musical apparatus comprising:

a tone generating section that generates a musical tone in accordance with a selected one of a plurality of installed timbres;

a receiving section that receives timbre designation information identifying a desired timbre from an external source;

a determining section that determines if the desired timbre corresponds to one of the plurality of installed timbres;

an installed timbre identification memory that stores said received timbre designation information if said determining section determines that the desired timbre corresponds to one of the plurality of installed timbres;

a selecting section that selects, if the determining section determines that the desired timbre corresponds to one of the plurality of installed timbres, the corresponding installed timbre; and a substitute section that selects, if the determining section determines that the desired timbre does not correspond to one of the plurality of installed timbres, a substitute timbre corresponding to timbre identification information previously received by said receiving section and stored in said installed timbre identification memory.

31. An electronic musical apparatus comprising:

a tone generating section that generates a musical tone signal in accordance with a selected one of a plurality of installed timbres;

a receiving section that receives timbre designation information which designates at least a first timbre and a second timbre for a musical tone signal; and a selecting section that selects the second timbre if the second timbre corresponds to one of the plurality of installed timbres and selecting the first timbre in place of the second timbre from the installed timbres if the second timbre does not correspond to one of the plurality of installed timbres, wherein the tone generating section generates a musical tone signal in accordance with the first timbre in place of the second timbre, when the second timbre is not present in the plurality of installed timbres.

* * * * *